United States Patent [19]

Moriya et al.

[11] Patent Number: 4,538,579

[45] Date of Patent: Sep. 3, 1985

[54] FUEL SUPPLY CONTROL SYSTEM

[75] Inventors: Kouichi Moriya; Kouki Iwata, both of Higashimatsuyama, Japan

[73] Assignee: Diesel Kiki Co., Ltd., Tokyo, Japan

[21] Appl. No.: 585,586

[22] Filed: Feb. 3, 1984

[30] Foreign Application Priority Data

Mar. 4, 1983 [JP] Japan ..... 58-034402

[51] Int. Cl.[3] ..... F02B 3/00; F02D 35/00

[52] U.S. Cl. ..... 123/492; 123/480; 123/478; 123/494; 123/340

[58] Field of Search ..... 123/478, 480, 492, 493, 123/494, 340

[56] References Cited

U.S. PATENT DOCUMENTS 4,126,107 11/1978 Harada et al. ..... 123/492
4,313,408 2/1982 Collonia ..... 123/340
4,366,541 12/1982 Mouri et al. ..... 123/480
4,391,250 7/1983 Matsui ..... 123/492
4,401,080 8/1983 Otsuka et al. ..... 123/492
4,418,673 12/1983 Tominari et al. ..... 123/480

*Primary Examiner*—Raymond A. Nelli
*Attorney, Agent, or Firm*—Wenderoth, Lind & Ponack

[57] ABSTRACT

A fuel supply control system for an internal combustion engine has a step motor driver for outputting excitation pulses to an excitation circuit for a step motor and a comparator supplied with a target step position of the step motor from a target step position memory and a present step position of the step motor from a current step position memory. The comparator is responsive to an output from a step motor speed setting unit which corresponds to a main power supply voltage detected by a voltage detector for comparing the target and present step positions. The step motor driver is responsive to an output from the comparator for issuing excitation pulses to the excitation circuit to turn the step motor by one step in one direction or the other until the present step position is equal to the target step position.

1 Claim, 6 Drawing Figures

FUEL SUPPLY CONTROL SYSTEM

BACKGROUND OF THE INVENTION

The present invention relates to a fuel supply control system for controlling the amount of fuel supplied to an internal combustion engine, and more particularly to a fuel supply control system in which a fuel supply control means is driven by a step motor.

Fuel supply control means such as throttle valves in spark ignition engines and control levers in diesel engines have conventionally been driven by a step motor which is energized to a step position corresponding to a position to which an accelerator pedal is depressed for thereby effecting fuel supply control.

Prior fuel supply systems have been disadvantageous in that the torque generated by the step motor varies due to variations in a power supply voltage applied to a step motor exciting circuit, so that the step motor tends to fail to produce a torque necessary for actuating the fuel supply control means, resulting in a step-out. One solution has been to use a feedback potentiometer, for example, for detecting the position of the step motor rotor to achieve increased operation reliability.

SUMMARY OF THE INVENTION

With the foregoing drawback in view, it is an object of the present invention to provide a fuel supply control system for use in an internal combustion engine, in which the speed of rotation (P.P.S) of a step motor is controlled dependent on the voltage of a power supply for an excitation circuit for the step motor.

According to the present invention, there is provided a fuel supply control system for controlling an amount of fuel supplied to an internal combustion engine by driving a step motor which is operatively coupled to fuel supply control means of the engine and having an excitation circuit, the fuel supply control system comprising an accelerator-pedal position detector means for detecting a position to which an accelerator pedal is depressed, a voltage detector means for detecting the value of the voltage output by a power supply used for a excitation circuit, a step motor speed setting means for generating an output at a period which is dependent on a rotational speed of the step motor which corresponds to the supply voltage value detected by the voltage detector means, a target step position memory means for storing a target step position of the step motor corresponding to an output from the accelerator-pedal position detector means, a present step position memory means for storing a present step position of the step motor, a comparator means for comparing the stored content of the target step position memory means with the stored content of the present step position memory means each time an output is issued from the step motor speed setting means, and a driver means responsive to an output from the comparator means for selectively issuing excitation pulses to the excitation circuit so as to turn the step motor by one step in one direction and incrementing the stored content of the present step position memory means by one, or issuing excitation pulses to the excitation circuit so as to turn the step motor by one step in an opposite direction and decrementing the stored content of the present step position memory means by one, until the stored content of the present step position memory means is made equal to the stored content of the target step position memory means.

The above and other objects, features and advantages of the present invention will become more apparent from the following description when taken in conjuction with the accompanying drawings in which a preferred embodiment of the present invention is shown by way of illustrative example.

DESCRIPTION OF THE PREFERRED EMBODIMENT

In the following embodiment of the present invention, a step motor for actuating a fuel supply control means such as a throttle valve, for example, is shown and described as comprising a four-phase step motor drivable for rotation with two phases excited at a time.

The present invention is applicable generally to internal combustion engines such as spark ignition engines and diesel engines.

Figure 1:
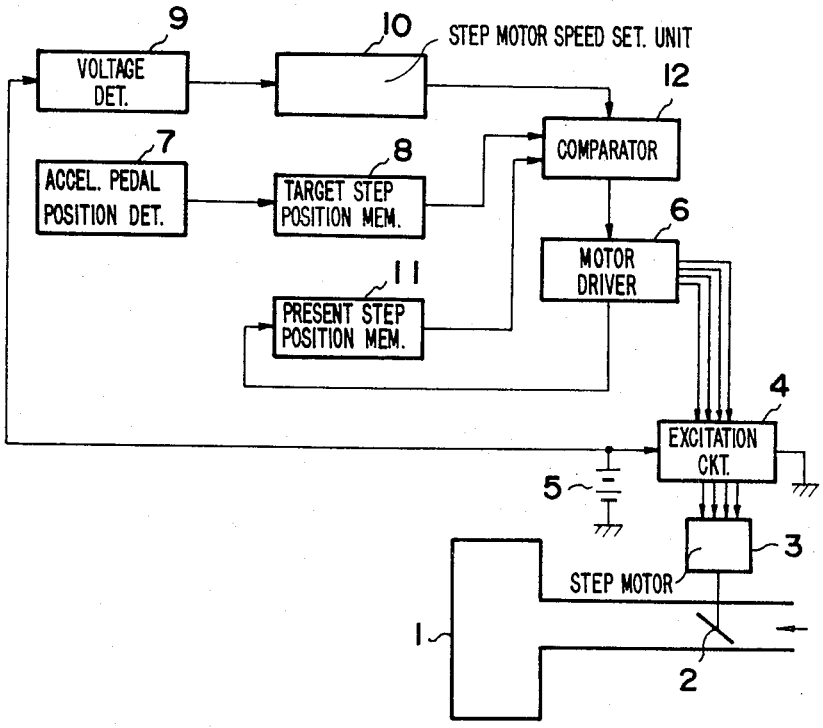
FIG. 1 is a block diagram of a fuel supply control system according to an embodiment of the present invention.

FIG. 1 shows a fuel supply control system according to an embodiment of the present invention for controlling fuel supply to a spark ignition engine 1 such as a gasoline engine.

The spark ignition engine 1 has a throttle valve 2 which is actuatable to provide desired valve openings for controlling the amount of an air-fuel mixture supplied into engine cylinders. The throttle valve 2 is operatively coupled to a step motor 3 drivable in steps by an excitation circuit 4 according to two-phase excitation pulses supplied from a step motor driver 6. The voltage from a voltage source 5 is supplied as a power supply voltage to the excitation circuit 4.

A position to which an accelerator pedal is depressed is detected by an accelerator pedal position detector 7, and a target step position for the step motor 3 which corresponds to the detected accelerator pedal position is stored in a target step position memory 8. The voltage of the voltage source 5 is detected by a voltage detector 9, which controls a step motor speed setting unit 10 to generate output pulses at a period dependent on the speed of rotation (P.P.S.) of the step motor 3 which corresponds to the voltage of the voltage source 5.

The step position of a rotor of the throttle valve 2 corresponds to the opening of the step motor 3. The present step position of the rotor of the step motor 3 is stored in a present step position memory 11. Each time an output pulse is generated by the step motor speed setting unit 10, a comparator 12 compares the stored content of the present step position memory 11 with the stored content of the target step position memory 8.

If the stored content of the target step position memory 8 is greater than the stored content of the present step position memory 11 as a result of comparison in the comparator 12, then the motor driver 6 outputs excitation pulses to the excitation circuit 4 so as to drive the step motor 3 by one step for actuating the throttle valve 2 in an opening direction through an angular interval corresponding to one step of the step motor 3. The stored content of the present step position memory 11 is increased by incrementing the same by 1. If the stored content of the target step position memory 8 is smaller than the stored content of the present step position memory 11 as a result of the comparison in the comparator 12, then the motor driver 6 outputs excitation pulses to the excitation circuit 4 so as to drive the step motor 3 by one step for actuating the throttle valve 2 in a closing direction through an angular interval corresponding to one step of the step motor 3. The stored content of the present step position memory 11 is reduced by decrementing the same by 1. If the stored content of the target step position memory 8 is equal to the stored content of the present step position memory 11 as a result of the comparison in the comparator 12, then the step motor 3 is not driven so as to keep the throttle valve 2 opened to the same extent as before. The foregoing operation is repeated each time an output pulse is output from the step motor speed setting unit 10 so to control an amount of fuel to be supplied to the engine 1.

Figure 2:
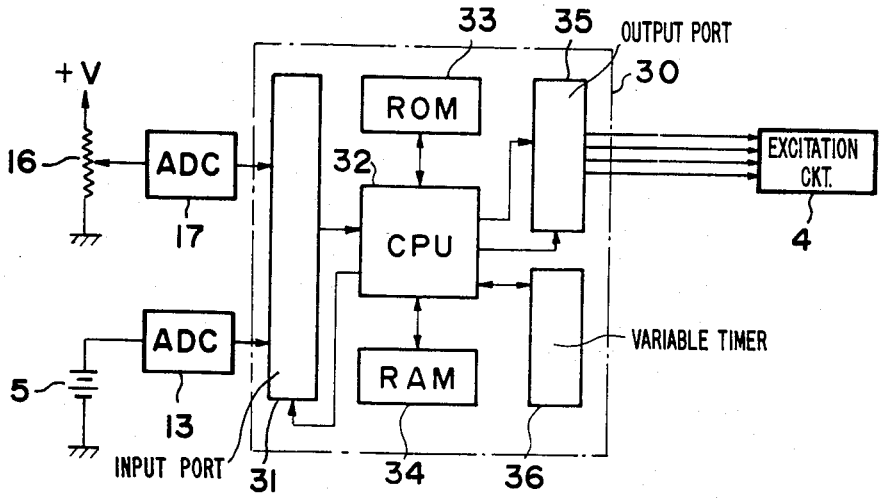
FIG. 2 is a block diagmam showing a microcomputer and input and output devices which implement the fuel supply control system of the present invention.

FIG. 2 shows a microcomputer and input and output devices by which the fuel supply control system of the first embodiment is implemented.

The microcomputer, which is generally designated by 30 and of a known construction, is basically composed of an input port 31, central processing unit (CPU) 32, a read-only memory (ROM) 33, a random-access memory (RAM) 34, an output port 35, and a variable timer 36 comprising a counter timer controller. The ROM 33 stores a program for controlling the CPU 32 to achieve the functions described with reference to FIG. 1. The microcomputer 30 is functionally equivalent to the motor driver 6, the target step position memory 8, the step motor speed setting unit 10, the present step position memory 11, and the comparator 12.

Figure 3:
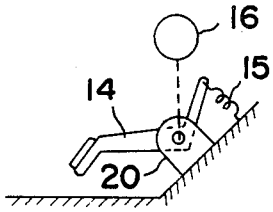
FIG. 3 is a side elevational view of an accelerator pedal.

The voltage of the voltage source 5 is converted by an analog-to-digital converter 13 into digital data. The analog-to-digital converter 13 serves as the voltage detector 9. As shown in FIG. 3, an accelerator pedal 14 is pivotally supported by a pivot shaft thereof on a bearing 20 fixed to a stationary base. The accelerator pedal 14 has one end projecting over a vehicle floor near a driver's seat and an opposite end coupled to a coil spring 15 which normally urges the accelerator pedal 14 to turn clockwise about the bearing 20. The pivot shaft of the accelerator pedal 14 is operatively connected to a potentiometer 16 so that the potentiomer 16 can detect a position to which the accelerator pedal 14 is depressed. An output voltage from the potentiometer 16 is converted by an analog-to-digital converter 17 into digital data which is supplied to the input port 31. Accordingly, the potentiometer 16 and the analog-to-digital converter 17 serve as the accelerator pedal position detector 7 illustrated in FIG. 1.

The input port 31 comprises a multiplexer for selectively supplying the output digital data from the analog-to-digital converters 13, 17 to the CPU 32 in response to a selection signal issued by the CPU 32 under the control of the program stored in the ROM 33.

The variable timer 36 comprises a frequency-divider for frequency-dividing a clock signal in the microcomputer 30 and a programmable down counter for counting down the frequency-divided output from the frequency divider. A frequency-division ratio for the frequency divider and a preset value for the programmable down counter can be set by the program stored in the ROM 33 through the CPU 32. The variable timer 36 outputs an interrupt signal upon the passage of a period of time determined by the frequency-division ratio and the preset value.

The CPU 32 processes the inputs read therein, stores the inputs in given areas in the RAM 34, updates the stored contents of the RAM 34, executes a process according to the program stored in the ROM 33 in response to the interrupt signal, and outputs processed outputs through the output port 35 to the excitation circuit 4 according to the program stored in the ROM 38. The output port 35 comprises a latch circuit for receiving a port indicating number from the CPU 32 and for temporarily storing output data in an indicated port and supplying the stored output data to the excitation circuit 4.

The excitation circuit 4 is supplied with the output from the output port 35, that is, two-phase exciting pulses in the present embodiment, and amplifies the supplied output for exciting the stator coils of the step motor 3.

Figure 4:
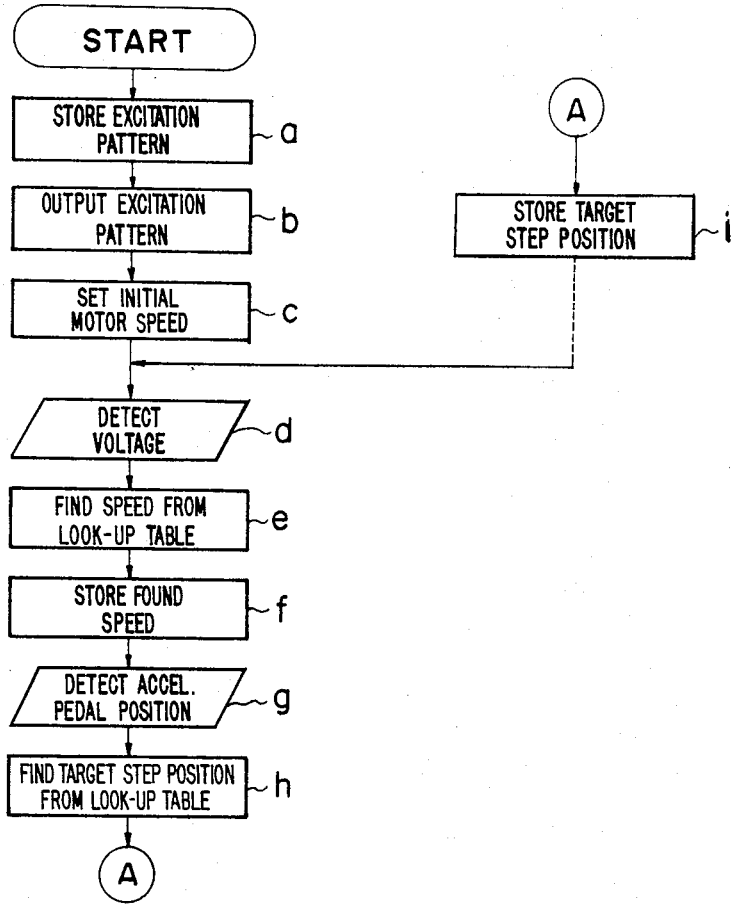
FIGS. 4 and 5 are flowcharts showing operation of the fuel supply control system of the present invention.
Figure 5:
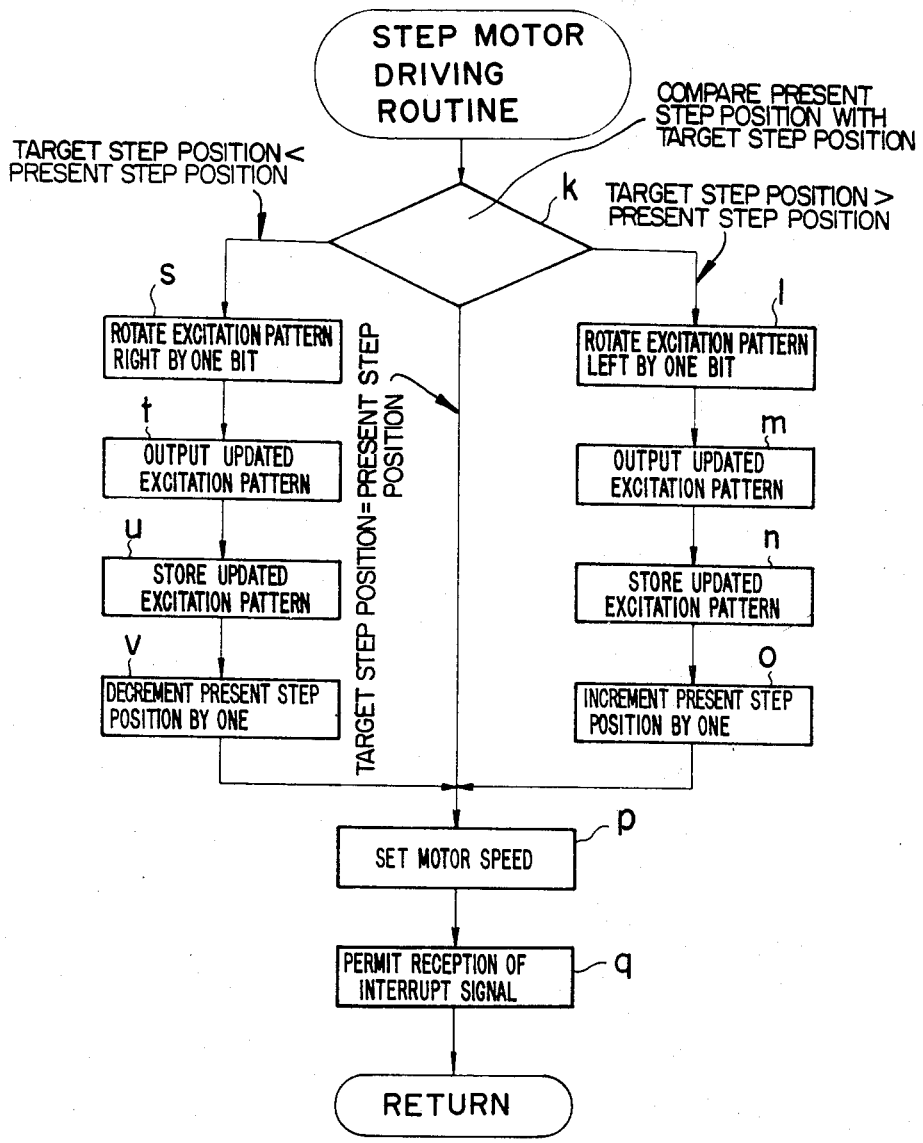

The program stored in the ROM 33 is illustrated in the flowcharts of FIGS. 4 and 5. The operation of the fuel supply control system according to the present invention will now be described with reference to FIGS. 4 and 5.

When the program starts to be executed, the microcomputer 35 clears stored contents of a step motor speed storage area, a target step position storage area, and a present step position storage area in the RAM 34, sets the variable timer 36 to a timer mode, and then stores a bit pattern corresponding to a phase number and an excitation method for the step motor 3 in a given area in the RAM 34 for initializing (program step a). Since the step motor used in this embodiment is a four-phase step motor with two phases excited at a time, the bit pattern comprises an 8-bit pattern of 33 (H), for example, ("H" means a hexadecimal notation) and four low-order bits are used for driving the step motor. The four bits used correspond, from LSB, to a, b, c, and d phases of the step motor. When the step motor is excited in the order of . . . a and b phases, b and c phases, c and d phases, d and a phases, . . . , the rotor of the step motor is turned clockwise to open the throttle valve 2. Conversely, when the step motor is excited in the order of . . . a and d phases, d and c phases, c and b phases, b and a phases, . . . , the rotor of the step motor is turned counterclockwise to close the throttle valve 2.

Figure 6:
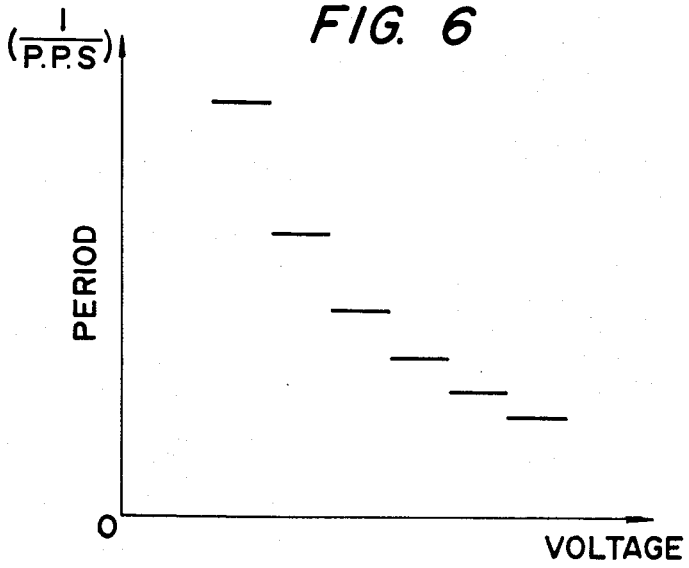
FIG. 6 is a diagram showing a table of voltages and rotational speeds of a step motor.

The stored content of the excitation pattern storage area is delivered through the output port 35 to the excitation circuit 3, by which the excitation pattern is amplified and supplied to the step motor 3 (program step b). In response to execution of the program step b, the a and b phases of the step motor are excited to bring the rotor to a reference step position in which the throttle valve 2 is fully closed. The step motor is then de-energized to stop the rotor in the reference step position. Then, in a program step c, the variable timer 36 is set to an initial period of time which is selected to be the reciprocal of the speed of rotation (P.P.S.) of the step motor 3 which is capable of driving the throttle valve 2 at the time that the lowest allowable voltage is supplied from the voltage source, that is, the period of excitation pulses for driving the step motor 3. After the variable timer 36 has been initially set, the output data from the analog-to-digital converter 13 is read (program step d), a speed of rotation of the step motor 3 is found from a look-up table containing step motor speeds and corresponding voltages of the voltage source 5 (program step e), and the step motor speed corresponding to the output digital data from the analog-to-digital converter 13 is stored in the step motor speed storage area (program step f). The speeds of rotation (P.P.S.) are stored in the look-up table as the reciprocals thereof or periods. As shown in FIG. 6, the look-up table is arranged such that the excitation pulse period becomes shorter (that is, the rotational speed becomes greater) as the voltage is increased.

Then, the program goes to a program step g which reads the output data from the analog-to-digital converter 17, to a program step h in which a target step position is found from a look-up table containing target step positions and corresponding accelerator pedal positions, and to a program step i in which the target step position corresponding to the output digital data from the analog-to-digital converter 17 is stored in the target step position storage area. The target step positions are stored in this look-up table as step motor step numbers with the fully closed position of the throttle valve 2 serving as a reference.

The program step i is followed by other programs steps that are not directly related to the present invention, and then the program goes back to the program step d to repeat the program steps d through i and the other program steps. When the voltage of the voltage source 5 is changed while the above program steps are repeated, the stored content of the step motor speed storage area is updated dependent on the voltage of the voltage source 5, and when the accelerator pedal position is changed while the same program steps are repeated, the stored content of the target step position storage area is updated dependent on the accelerator pedal position.

The variable timer 36 which is set to the initial period of time in the program step c counts time by frequency-dividing the clock signal in the microcomputer 30 and counting down the frequency-divided clock signal, and outputs an interrupt signal when the set initial period of time elapsed while the program is executing the main routine composed of the program steps d through i and then back to d. The program is then caused by the interrupt signal to interrupt the execution of the main routine after any command from the ROM 33 that has been executed when the interrupt signal is generated is completed and to execute an interrupt routine or step motor driving routine as shown in FIG. 5.

As shown in FIG. 5, the accelerator-controlled routine is started by comparing the stored content of the target step position storage area with the stored content of the present step position storage area (program step k). If the variable timer reaches the initial period of time, then the stored content of the present step position storage area remains in the initialized condition, and the target step position storage area stores a target step position number corresponding to the accelerator pedal position immediately prior to generation of the interrupt signal. If the accelerator pedal is not depressed, then the stored content of the target step position storage area is zero.

If the accelerator pedal 14 is depressed, then the stored content of the target step position storage area is greater than the stored content of the present step position storage area, and the stored content of the excitation pattern storage area is rotated left by one bit (program step l). The left rotation causes the stored content of the excitation pattern storage area to change from 33 (H) to 66 (H). The updated excitation pattern is output through the output port 35 (program step m). In response to the output excitation pattern, the b and c phases of the step motor 3 are excited by the excitation circuit 4 to turn the rotor of the step motor 3 clockwise by one step. As a result, the throttle valve 2 is angularly moved through an interval corresponding to one step of the step motor 3. Then, the new excitation pattern 66 (H), instead of the previous excitation pattern 33 (H), is stored in the exciting pattern storage area (program step n). The stored content of the present step position storage area is thereafter incremented by 1 (program step o). In response to this increment, the stored content of the present step position storage area is updated into data corresponding to the new opening of the throttle valve 2 achieved by the program step m. The updating of the stored content of the present step position storage area is followed by a program step p in which the variable timer 36 is set to a period of time corresponding to the stored content of the step motor speed storage area. The variable timer 36 is now set to value corresponding to the voltage of the voltage source 5. The program goes from the program step p to a program step q in which an interrupt signal, generated by the timer 36, for example, is permitted to be received, and the system returns to the main routine.

If the stored content of the target step position storage area is equal to the stored content of the present step position storage area in the program step k, then the program steps p and q are executed following the program step k, and the program goes back to the main routine. At this time, the step motor 3 is not driven clockwise or counterclockwise, and the opening of the throttle valve 2 remains the same as before.

The operation as described above starts from the time when the variable timer 36 reaches the initial period of time. A process in which the variable timer 36 is set to a period of time in the program step p and the variable timer 36 reaches such a period of time remains the same as such operation. Each time the program steps k, l through q are executed, the excitation circuit 4 is successively supplied with excitation pulses of . . . , 33 (H), 66 (H), CC (H), 99 (H), 33 (H), . . . . Therefore, the a and b phases, b and c phases, c and d phases, d and a phases, a and b phases, . . . of the step motor 3 are successively executed each time the program steps k, l through q are executed, thereby driving the throttle valve 2 in an opening direction. The period at which the step motor 3 is driven by each step is equal to the period of time set in the variable timer 36 in the program step p. This period of time corresponds to the voltage of the voltage source 5. Accordingly, the higher the voltage of the voltage source 5, the greater the rotational speed at which the step motor 3 is driven stepwise.

When the step motor 3 is driven and the throttle valve 2 is open, there may be an instance in which the stored content of the target step position storage area is smaller than the stored content of the present step position storage area in the program step k. In such an instance, the accelerator pedal is displaced back from an accelerator pedal position corresponding to the present throttle valve opening. When this happens, the stored content of the excitation pattern storage area is rotated right by one bit (program step s). The right rotation of the excitation pattern updates the excitation pattern from 33 (H) to 99 (H), from 99 (H) to CC (H), from CC (H) to 66 (H), or from 66 (H) to 33 (H), a procedure opposite to that in the program step l. The updated excitation pattern is delivered through the output port 35 (program step t). The excited phases of the step motor 3 are then changed from the a and b phases to d and a phases, from the d and a phases to c and d phases, from the c and d phases to b and c phases, or from the b and c to a and b phases, to turn the rotor counterclockwise by one step. As a consequence, the throttle valve 2 is angularly displaced in a closing direction for an interval corresponding to one step of the step motor 3. Then, the new excitation pattern, instead of the previous excitation pattern, is stored in the excitation pattern storage area (program step u). The stored content of the present step position storage area is thereafter decremented by 1 (program step v). In response to this decrement, the stored content of the present step position storage area is updated into data corresponding to the new opening of the throttle valve 2 achieved by the program step t. The renewal of the stored content of the present step position storage area is followed by execution of the program steps p and q, and then the program returns to the main routine. Each time the program steps k, s through q are executed, the excitation circuit 4 is successively supplied with excitation pulses of . . . , 33 (H), 99 (H), CC (H), 66 (H), 33 (H), . . . . Therefore, the step motor 3 is turned counterclockwise by one step each time the program steps k, s through q are executed, thereby driving the throttle valve 2 in a closing direction. The period at which the step motor 3 is driven by each step is equal to the period of time set in the variable timer 36 in the program step p. This period of time corresponds to the voltage of the voltage source 5. The higher the voltage of the voltage source 5, the greater the rotational speed at which the step motor 3 is driven stepwise.

The foregoing operation is repeated until the throttle valve 2 is controlled to provide a target opening at the rotational speed of the step motor 3 dependent on the power supply voltage applied to the exciting circuit 4.

The present invention is equal applicable to a step motor having phases other than four and with phases other than two being excited at a time, the requirement being that the excitation patterns be bit patterns corresponding to the number of phases used and the excitation method of a step motor employed.

The invention has been shown and described as being incorporated into a spark ignition engine. Where the present invention is applied to diesel engines, the control lever of a fuel injector may driven by the step motor 3.

With the arrangement of the present invention, the step motor is driven at a rotational speed corresponding to a power supply voltage applied to the excitation circuit for the step motor. Therefore, the step motor is prevented from suffering from a step-out even when the power supply voltage applied to the exciting circuit is varied.

Since the position of the fuel supply control means or the throttle valve can be detected by the stored content of the present step position storage means, there is no need for a feedback potentiometer, for example, for the step motor, and the actuator for the fuel supply control means takes up a small space.

Although a certain preferred embodiment has been shown and described, it should be understood that many changes and modifications may be made therein without departing from the scope of the appended claim.

What is claimed is:

1. A fuel supply control system for controlling an amount of fuel supplied to an internal combustion engine by driving a step motor operatively coupled to fuel supply control means of the engine and having an excitation circuit, comprising:

(a) an accelerator-pedal position detector means for generating an output correspondiing to a position to which an accelerator pedal is depressed;

(b) a voltage detector means for generating an output corresponding to a power supply voltage supplied to said excitation circuit;

(c) a step motor speed setting means for generating an output at a period dependent on a rotational speed of the step motor which corresponds to said output from the voltage detector means;

(d) a target step position memory means for storing a target step position of the step motor corresponding to said output from said accelerator-pedal position detector means;

(e) a present step position memory means for storing a present step position of the step motor;

(f) a comparator means for comparing the stored content of said target step position memory means with the stored content of said present step position memory means each time an output is provided by said step motor speed setting means; and (f) a driver means responsive to an output from said comparator means for selectively outputting excitation pulses to said excitation circuit so as to turn said step motor by one step in one direction and for incrementing the stored content of said present step position memory means by one and for outputting excitation pulses to said excitation circuit so as to turn said step motor by one step in an opposite direction and for decrementing the stored content of said present step position memory means by one, said step motor direction and changing of the stored content of said present step position memory being dependent upon an output from said comparator means, said driver means outputting excitation pulses until the stored content of said present step position memory means is equal to the stored content of said target step position memory means.

* * * * *